US005157640A

United States Patent [19]

Backner

[11] Patent Number: 5,157,640

[45] Date of Patent: Oct. 20, 1992

[54] MEDICATION ALERT WATCH AND SYSTEM

[76] Inventor: Brian P. Backner, 17 Margaret Rd., Sharon, Mass. 02067

[21] Appl. No.: 551,627

[22] Filed: Jul. 11, 1990

[51] Int. Cl.[5] ..... G04B 47/00

[52] U.S. Cl. ..... 368/10; 368/41

[58] Field of Search ..... 368/10, 70–113, 368/2, 3, 15

[56] References Cited

U.S. PATENT DOCUMENTS 3,739,740 6/1973 Fromer .
3,762,601 10/1973 McLaughlin .
3,917,045 11/1975 Williams et al. .
4,223,801 9/1980 Carlson .
4,258,354 3/1981 Carmon et al. .
4,275,384 6/1981 Hicks et al. .
4,293,845 10/1981 Villa-Real .
4,504,153 3/1985 Schollmeyer et al. .
4,674,652 6/1987 Aten et al. .
4,837,719 6/1989 McIntosh et al. .

*Primary Examiner*—Bernard Roskoski
*Attorney, Agent, or Firm*—Hamilton, Brook, Smith & Reynolds

[57] ABSTRACT

An electronic watch may be programmed by direct link to a pharmacist's computer to store a medication regimen. When a medication is to be taken, an alarm is sounded, and the medication and dosage are identified on the display of the watch. A number of tones are periodically generated, the number of tones corresponding to the number of types of medications which are to be taken at a given time. Several medications may be displayed successively as a reset button is set. To program the watch, the watch is placed in a cradle which couples to a communications port on the watch to provide communications with the pharmacist's computer.

24 Claims, 4 Drawing Sheets

| | | | |
|---|---|---|---|
| 28- | NAME | 33- | MD NAME |
| 29 | ADDRESS | 34 | ADDRESS |
| | " | | " |
| | " | | " |
| | " | | " |
| 30- | PHONE # | -35 | PHONE # |
| 31- | SSN | 36 | ID A |
| 32 | ALLERGIES | | |

| | 37 | 38 | 39 | 40 | 41 | 42 | 43 |
|---|---|---|---|---|---|---|---|
| | MEDICATION | MD | DOSAGE | DAYS OF WEEK | TIMES | START | STOP |
| 44 | DICOXIN | A | 0.125mg | ALL | 8.00A | 4-1-79 | |
| 45 | THEODUR | A | 300mg | ALL | 8:00A; 8:00P | 5-27-84 | |
| 46 | LASIX | A | 40mg | M,W,F | 8:00A | 4-1-79 | |
| 47 | DILANTIN | B | 300mg | ALL | 8:00A | 6-1-88 | |
| | | | 150mg | ALL | 6:00P | 6-22-88 | |
| 48 | COOMADIN | C | 5.0mg | EVERY OTHER | 8:00A | 4-1-79 | |
| | | | 7.5mg | EVERY OTHER | 8:00A | 4-1-79 | |
| 49 | VIT $B_{12}$ | A | 1000$\mu$g | FIRST OF MONTH | 8:00A | 4-1-79 | |
| 50— | EMYCIN | A | 333mg | ALL | 8:00A;3:00P;10:00P | 4-1-89 | 9-11-89 |

FIG. 7

MEDICATION ALERT WATCH AND SYSTEM

BACKGROUND OF THE INVENTION

Noncompliance, defined in medical parlance as the failure to follow through with therapy as prescribed by one's physician, has long been recognized as a major impediment to improved patient health. Nowhere is the problem of noncompliance more evident than in the taking of prescription medication.

Reasons for failure to take medications as prescribed, in either the proper dosage or at the specified time(s), range from honest forgetfulness or misunderstanding to the rare patient who mentally denies existence of the illness for which the medication was prescribed. It has been recognized that the more frequently a medication must be taken, the less likely is the patient's compliance. For this reason, pharmaceutical companies spend incalculable sums of time and money developing medications that need only be taken once daily. However, because of difficulties with absorption, biodegradation, renal elimination, and so on, many medications are not amenable to once daily dosing regimens.

For the patient who must take three, four or more medications daily, each requiring three of four dosages daily, it can quickly become confusing as to what medication and dose need be taken when. Many patients carry written "timetables" with them, sometimes with actual pills or capsules taped to them, to help them take their medications. If they should forget to look at this timetable, or should they be distracted, however, it would not be uncommon to miss one or more medications. The cost of noncompliance can be counted in both human suffering as well as monetary terms, particularly as health care expense is an increasing part of our nation's economic output. Hence, any device which can improve compliance should produce both social as well as economic benefits.

DISCLOSURE OF THE INVENTION

The present invention provides a programmable, electronic, auditory and visual reminder of medications to be taken, no matter how frequent dosing might be. The preferred embodiment of the invention doubles as a normal LCD wristwatch, and the physician- or pharmacist-only programmable watch is capable of giving instructions for ten or more medications and can accommodate both constant and variable dosing regimens. Instead of the usual time, day and date, when a medication is to be taken, the watch steadily displays the name and dosage of the medication; it also emits an auditory tone every five seconds. After the patient has taken the medication, he "turns off" the medication display by depressing a button at the side of the watch. If more than one medication is to be taken, the watch signals the corresponding number of times and sequentially displays the names and dosages of the medications as the patient indicates that he has taken each one by depressing the "off" button.

As a safety feature of the preferred embodiment, patients are not allowed to program the watch to display their dosing schedule; nor can the alarm on the watch be programmed to go off at times other than when medications are to be taken. Rather, pharmacists are the primary programmers of the watch as they are responsible for taking physicians' prescriptions and working out actual dosing schedules with patients. To make this task easy and fast for busy pharmacists, the watch is programmed through the pharmist's computer rather than with buttons or keys on the side of the watch. The program, preferably either IBM or MacIntosh compatible, is supplied to dispensing pharmacists. Through the computer display, the program asks for the patient's name, address, phone number, Social Security number, physician(s), diagnosis and medications, their dosage and frequency. A dedicated cradle holds the watch in place. By means of pins in the cradle matching receptacles in the watch, dosing information from the pharmacist's computer is transferred to the watch. When a physician changes either a patient's medication or the dosage on an existing prescription, it is the patient's responsibility to return to the pharmacist who will then reprogram the watch.

Thus, in accordance with the present invention, an electronic watch comprises an electronic display and an audible alarm. A programmable storage stores a medical regimen including identification of medications and times at which the medications are to be taken. Control electronics responsive to the programmable storage initiate the audible alarm and display of identification of a medication when the medication is to be taken.

Preferably, the audible alarm sounds periodically until the alarm and medication display are disabled by pressing of a button, and the watch is programmable to identify plural medications to be taken at a given time by displaying successive medications as said button is pressed. Preferably, the alarm generates a number of tones corresponding to the number of medications yet to be taken at a given time. The identification of the medication may comprise both the name and dosage of the medication.

In accordance with a further feature of the present invention, the watch comprises a communications port for coupling of the watch to a host computer which programs the programmable storage. Preferably, the medical regimen is only storable in the programmable storage through the communications port. The programmable storage may store medical regimens on the basis of time within a day in successive or alternating days or days within a week or a month. Also, the programmable storage may store end dates of the medical regimen and cause further alarms and display of a medication to cease.

In a medication alert system, the communications link of the above-described watch may be coupled to a computer by placement of the watch in a cradle. Through the communications link provided by the cradle, medical regimens may be transferred from the computer and stored in the programmable storage of the electronic watch.

The computer may be programmed to retrieve identification information from the watch. That information may be compared with information input by a user to the computer and information corresponding to regimens previously stored in the computer to assure that proper data is being transferred to the watch. The computer is preferably programmed to store a detailed listing of patient identification and medication regimen for that patient. For each medication, an identification of the medication, a physician, dosage, days, times and start and stop dates may be input by a user.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon the principles of the invention.

FIG. 7 is a sample VDT display.

DESCRIPTION OF A PREFERRED EMBODIMENT

Figure 1:
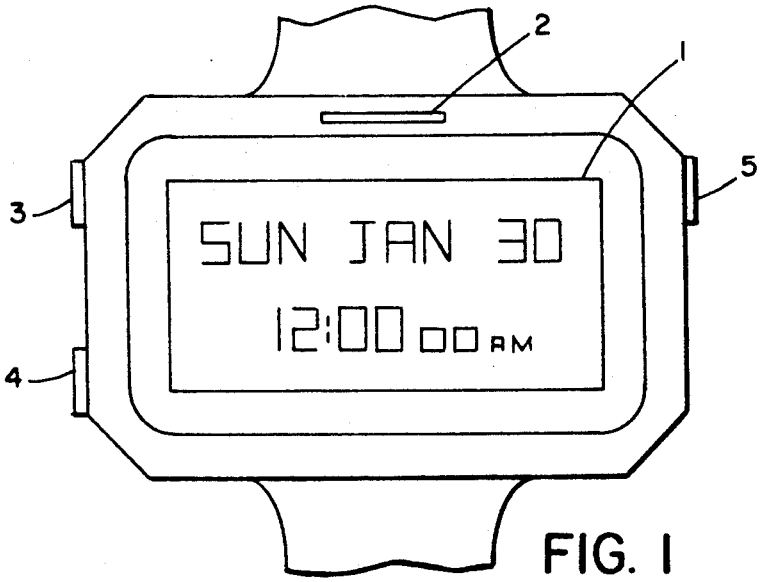
FIG. 1 is a top view of the LCD wristwatch embodying the present invention.
Figure 2:
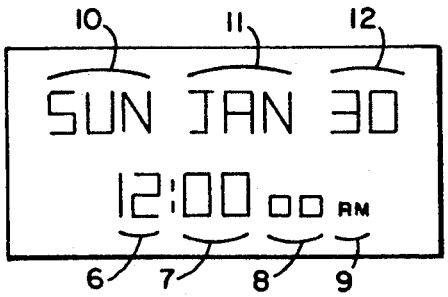
FIG. 2 is a closeup of the LCD display in the "standard" day-date time mode.
Figure 3:
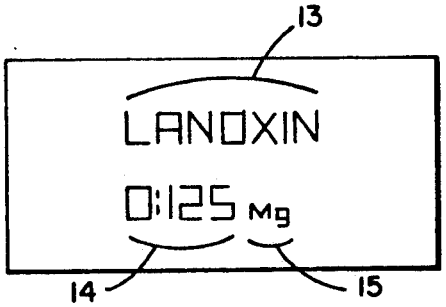
FIG. 3 is a closeup of the LCD display in the medication alert mode.
Figure 4:
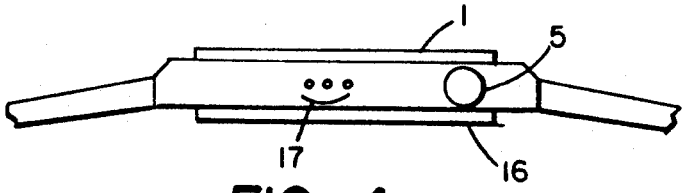
FIG. 4 is a side view of the wristwatch showing the data input ports.

The watch of the present invention is a wristwatch (FIG. 1) having a liquid crystal display (LCD) face 1 capable of displaying two distinct modes, "standard" mode as in FIG. 2, and "medication" mode as in FIG. 3. In addition, the watch has a piezo-electric alarm 2, "standard" mode programming buttons 3, 4, "alarm off" button 5, and data input ports 17 in FIG. 4. The watch should be shock and water resistant and contains within its electronic circuitry a perpetual calendar.

Figure 1A:
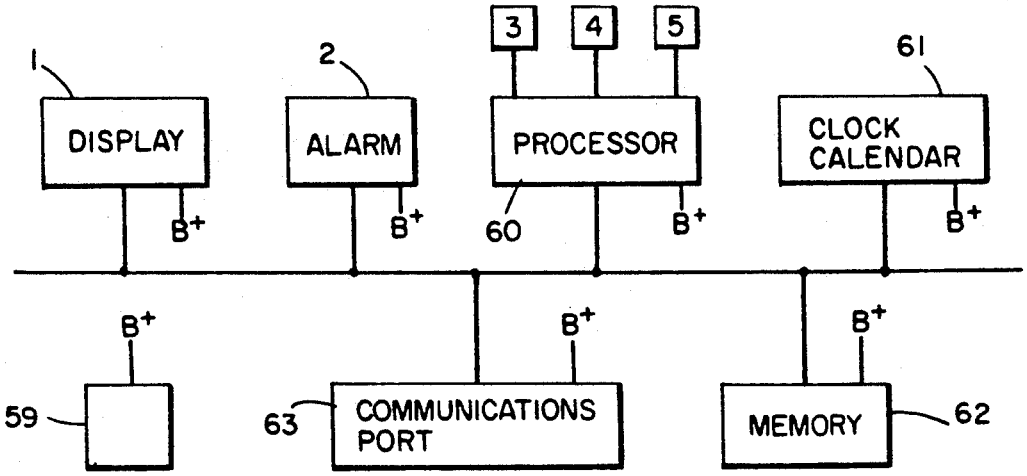
FIG. 1A is a functional block diagram of electronics of the watch.

As illustrated in FIG. 1A, the internal watch electronics are powered by a battery 59. The electronics include a control processor 60 which responds to the programming buttons 3 and 4 and the "alarm off" button 5 and which controls the display 1 and alarm 2. The electronics include a clock 61 which preferably tracks time and calendar date as well as day of the week. Programmable memory 62 stores identification of medications to be taken, their dosages and when they are to be taken. A significant feature of the electonics is a communication port 63. By means of this port, the watch medication regimen may be directly programmed from a pharmicist's computer as will be described below.

The electronics may be microprocessor-based as shown or may be a special purpose circuit, preferably formed on a single chip.

In "standard" mode (FIG. 2), the LCD face displays the time in hours 6, minutes 7, seconds 8, whether A.M. or P.M. 9, the day of the week 10 in a three-letter abbreviation, the month 11 in a three-letter abbreviation, and the date 12. This "standard" mode display can be set using the adjust button 3 (FIG. 1) and set button 4 (FIG. 1).

In "medication" mode (FIG. 3), the LCD face displays the name of a medication 13 and the dosage 14, 15 of that medication to be taken. Simultaneously, the piezo-electric alarm 2 sounds at five-second intervals, alerting the wearer to read the watch face and to take the medication and dosage displayed there. Thus alerted, the wearer may silence the alarm and return the LCD face to "standard" mode by depressing the "alarm off" button 5. In the case of a single medication to be taken, the audible alarm is a single 100 millisecond pulse which sounds at five-second intervals until cancelled. In the case of multiple medications to be taken simultaneously, the alarm is of multiple 100-millisecond pulses repeated at five-second intervals, i.e., three tone pulses for three medications, six tone pulses for six medications, etc. Depressing the "alarm off" button 5 replaces the display of the first medication and dosage to be taken with the next medication and dosage and decreases the number of tone pulses by one. The wearer continues to depress the "alarm off" button 5, noting each medication and dosage to be taken, until all medications have been cleared and the display returns to "standard" mode. In the event that the long-life lithium battery should need to be replaced, the display in "medication" mode alternately flashes the name of the medication to be taken with "BATT-LO", indicating the patient should take the watch to his pharmacist for battery replacement.

Names of medications 13 to be displayed (FIG. 3) may be up to ten letters, numbers, spaces or combination thereof. Should a medication name be entered that is longer than ten letters, only the first ten letters are displayed. It is intended that only brand or generic medication names, not descriptions such as "blue pill," be entered into the watch. The dosage display includes two parts 14, 15 (FIG. 3)—a four-digit numerical display 14 having a range form 0.0001 to 9999 and a "units" display 15 capable of the following: mg (milligrams), μg (micrograms), gm (grams), oz (ounces), cc (cubic centimeters or milliliters), ts (teaspoons), tb (tablespoons), un (units), pu (puffs).

Figure 5:
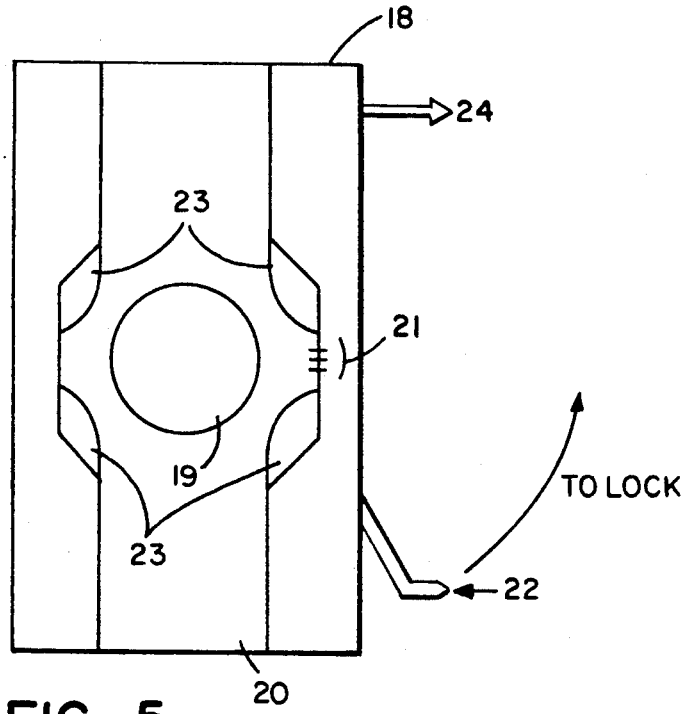
FIG. 5 is a top view of the data input cradle.

Programming medications into the watch are performed through the use of a dedicated cradle (FIG. 5) interfaced to the pharmacist's computer. The cradle housing (18) should be of nonconductive, shatter-resistant thermoplastic and serves to hold the watch while programming is taking place. An elliptical base plate 16 (FIG. 4) of the watch mates with a depression 19 (FIG. 5) in the central trough 20 of the cradle. This positive mating serves to orient the watch and maintain it in a constant spatial relationship to the data input pins 21 of the cradle. Once placed manually into position by the pharmacist, a cradle locking lever 22 is advanced to engage a four-point locking mechanism 23 and thereby holding the watch firmly in position. At the same time, the data input pins 21 of the cradle advance into the matching data input ports 17 (FIG. 4) on the body of the watch making data transfer and programming possible. Other communications links such as an optical link are also feasible. Data from the pharmacist's computer may then be transferred via a standard connecting cable 24 (FIG. 5).

Figure 6:
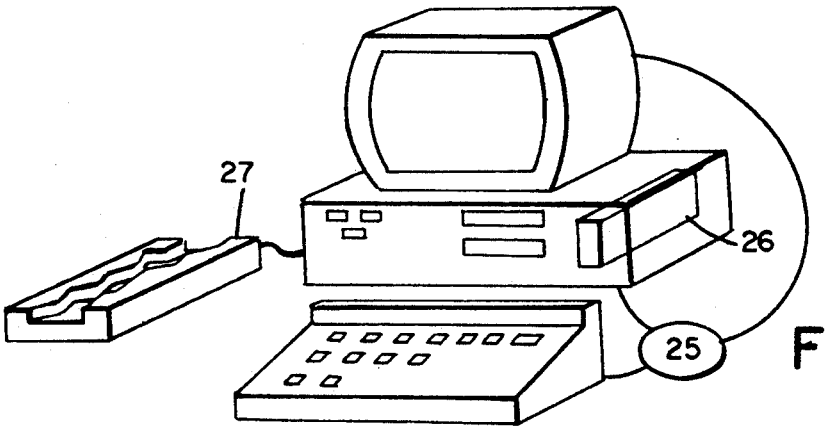
FIG. 6 is the system configuration.

In order to accommodate the watch and its programming in a typical installation, the major modification to the pharmacist's computer is the addition of a dedicated hard disc drive and controller. The hard disc contains all of the programming necessary to accept input-output instructions and data as supplied by the pharmacist. In all, the system comprises four major components (FIG. 6): the computer, the keyboard and CRT 25; the hard disc drive 26; the programming cradle and its connecting cable 27; and the watch itself.

Figure 8:
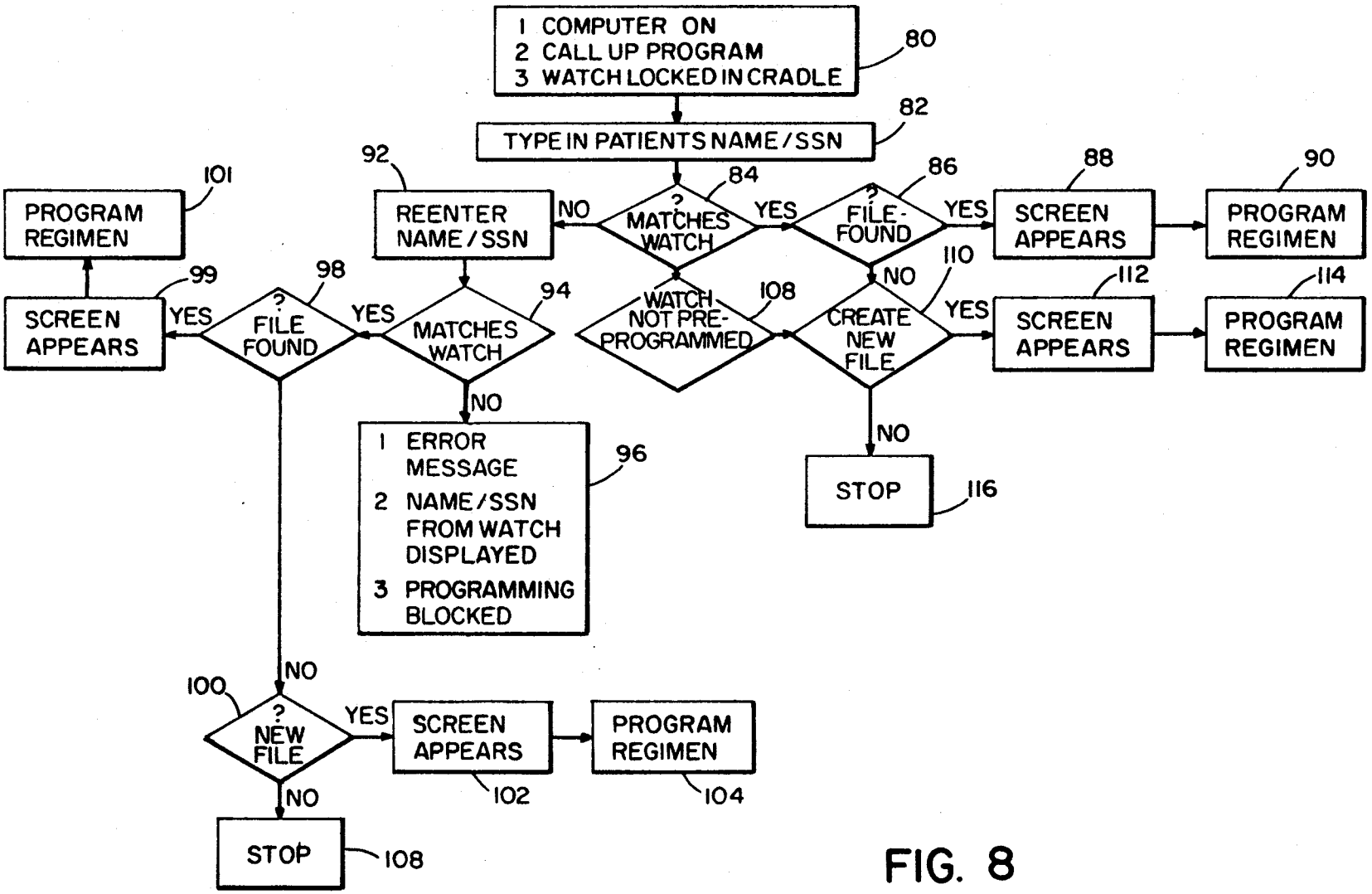
FIG. 8 is a flowchart of the software functions in programming the watch.

To program the watch, the computer is programmed to follow the functional flowchart of FIG. 8. At 80 the pharmacist first activates the dedicated hard disc drive and calls up the "medication" program. A watch is then placed into the cradle and locked into place. Through the computer display, the program then asks for the patient's name and Social Security number (SSN) at 82. Through the communications port with the watch, the program determines at 84 the identification information already programmed into the watch. If a match is found, a corresponding hard disc file is located at 86. If a match is found between the information input through the keyboard, the hard disc's files and that information already programmed into the watch, a screen similar to FIG. 7 appears at 88. The pharmacist may proceed to add, delete or alter medication(s) at 90.

Should no name/SSN match be found, the program asks for verification of the name's spelling and the SSN at 92. If the verified information does not match at 94 that already programmed into the watch sitting in the cradle, the program rejects any attempts to continue and displays an error message along with the name/SSN already programmed into the watch at 96. If the verified name/SSN do match that already programmed into the watch, and a file is found at 98, the screen of FIG. 7 is displayed at 99, and the regimen is programmed at 101. If no corresponding file is found to exist in the hard disc's files at 98, the program asks the pharmacist if a new file should be created at 100. If so, the screen of FIG. 7 appears at 102, and the regimen is programmed at 104. If not, the routine ends at 106.

Should an unprogrammed watch be placed into the cradle at 84, 108, the program asks that initialization be performed at 110. The pharmacist may then either create a new patient file or transfer an existing file into the watch. Again, the screen of FIG. 7 appears at 112, and the regimen is programmed at 114, or programming ends at 116.

To create a new patient file, see FIG. 7, the pharmacist inputs the patient's name 28, address 29, phone number(s) 30, SSN 31, any known drug allergies 32. In addition, the prescribing physician's name 33, address 34, and phone number 35 are also input. In the case of multiple prescribing physicians, each physician is assigned a letter 36. The pharmacist may then enter a medication and dosage regimen in columns 37–43. The name of the medication 37 is followed by the designating letter of the prescribing physician 38. The dosage 39 is then entered, followed by the days of the week 40 and time 41 it is to be taken. In addition, the date on which the medication is started 42 and the date on which it was/will be stopped 43 is also input.

The program is capable of accommodating multiple dosage regimens:

1) a single dosage given daily 44;
2) a single dosage given two or more times daily 45;
3) a single dosage given on different days 46;
4) a medication given in different dosages at different times 47;
5) a medication given in different dosages at different or alternate days 48;
6) a medication given once weekly or monthly 49; and
7) any combination of the above.

The program is also capable of accommodating medications that are to be self-limited, i.e., a 10-day course of an antibiotic 50. In this case, the pharmacist programs the medication 37, physician 38, dosage 39, days of the week 40, times 41 and start date 42 as before, but also inputs the date after which the medication is to be stopped 43. After the last dosage on the stop date, the watch automatically erases the medication from its memory. Likewise, the file contained on the dedicated hard disc removes a medication from its display after its stop date and places the information into back-up memory.

It is intended that whenever a medication is discontinued it will be deleted from the screen display and placed in back-up memory. Likewise, when a medication's dosage or regimen is altered, it is to be deleted from the screen display and placed into back-up memory. To delete a medication, the pharmacist need only input the current date into the stop date column 43, and it will automatically be placed into back-up memory. Back-up memory for any patient may be accessed at any time, giving an overview of a patient's medication history.

While this invention has been particularly shown and described with references to a preferred embodiment thereof, it will be understood by those skilled in the art that various changes in form and details may be made therein without departing from the spirit and scope of the invention as defined by the appended claims. For example, for the hearing impaired, a tactile or visual alarm may be provided.

I claim:

1. An electronic timepiece comprising:
an electronic display;
an audible alarm;
programmable storage which stores a medical regimen including identification of medications and times at which the medications are to be taken;
control electronics responsive to the programmable storage to initiate the alarm to periodically generate a number of alarm tones corresponding to the number of types of medications yet to be taken at a given time and display of identification and dosage of each medication type when that medication type is to be taken; and
a communications port for coupling the timepiece to a host computer which programs the programmable storage.

2. An electronic watch as claimed in claim 1 wherein the alarm sounds periodically until the alarm and medication display are disabled by pressing of a button.

3. An electronic watch as claimed in claim 2 programmable to identify plural medications to be taken at a given time by displaying successive medications as said button is pressed.

4. An electronic watch as claimed in claim 1 wherein the display of identification of a medication comprises display of the name and dosage of the medication.

5. An electronic watch as claimed in claim 1 wherein the medical regimen is only storable in the programmable storage through the communications port.

6. An electronic watch as claimed in claim 1 wherein the programmable storage stores medical regimens on the basis of alternating days.

7. An electronic watch as claimed in claim 1 wherein the programmable storage stores medical regimens on the basis of time within a day and days within a week or month.

8. An electronic watch as claimed in claim 7 wherein the programmable storage stores medical regimens on the basis of alternating days.

9. An electronic watch as claimed in claim 1 wherein the programmable storage is adapted to store end dates of a medical regimen and causes further alarms and display of a medication to cease.

10. An electronic timepiece comprising:
an electronic display;
an audible alarm;
programmable storage which stores a medical regimen including identification of medications and times at which the medications are to be taken, the storage being programmable to identify plural medication types to be taken at a given time; and control electronics responsive to the programmable storage to initiate the audible alarm to periodically generate a number of tones corresponding to the number of types of medications yet to be taken at a given time and to display identification and dosage of each medication type when that medication type is to be taken;

an activator for causing, upon each activation, the control electronics to successively display the identification and dosage of another medication type to be taken at that time and to reduce the number of tones by one; and a communications port for coupling the timepiece to a host computer which programs the programmable storage, the medical regimen only being storable in the programmable storage through the communications port.

11. An electronic watch as claimed in claim 10 wherein the display of identification of a medication comprises display of the name and dosage of the medication.

12. An electronic watch as claimed in claim 10 wherein the programmable storage stores medical regimens on the basis of time within a day in successive or alternating days or days within a week or month and wherein the programmable storage is adapted to store end dates of a medical regimen and causes further alarms and display of a medication to cease.

13. A medication alert system comprising:

a computer for storing a medical regimen including identification and dosage of each type of medication and times at which the medications are to be taken;

an electronic timepiece comprising:

an electronic display;

an alarm;

programmable storage which stores a medical regimen including identification and dosage of each type of medication and times at which the medications are to be taken; and control electronics responsive to the programmable storage to initiate an audible alarm to periodically generate a number of tones corresponding to the number of types of medications yet to be taken at a given time and display of identification and dosage of each medication type when that medication type is to be taken; and a communications link adapted to couple the computer and the electronic timepiece such that medical regimens are transferred from the computer and stored in the programmable storage of the electronic timepiece.

14. A system as claimed in claim 13 wherein the communications link is a cradle which physically supports the electronic watch and couples the computer to a communications port in the watch.

15. A system as claimed in claim 13 wherein the computer is programmed to retrieve identification information in the watch and to compare that information with identification information input by a user to the computer and identification information corresponding to regimens previously stored in the computer.

16. A system as claimed in claim 13 wherein the computer is programmed to store a patient identification and a medication regimen for that patient including, for each medication, an identification of the medication, a physician, dosage, days and times and start and stop dates.

17. An electronic timepiece as claimed in claim 15 comprising:

an electronic display;

an audible alarm;

programmable storage which stores a medical regimen including identification of medications and times at which the medications are to be taken, the storage being programmable to identify plural medication types to be taken at a given time; and control electronics responsive to the programmable storage to initiate the audible alarm to periodically generate a number of tones corresponding to the number of types of medications yet to be taken at a given time and to display identification and dosage of each medication type when that medication type is to be taken;

an activator for causing, upon each activation, the control electronics to successively display the identification and dosage of another medication type to be taken at that time and to reduce the number of tones by one; and a communications port for coupling the timepiece to a host computer which programs the programmable storage, the medical regimen only being storable in the programmable storage through the communications port.

18. An electronic watch as claimed in claim 17 wherein the display of identification of a medication comprises display of the name and dosage of the medication.

19. An electronic watch as claimed in claim 18 wherein the programmable storage stores medical regimens on the basis of time within a day in successive or alternating days or days within a week or month and wherein the programmable storage is adapted to store end dates of a medical regimen and causes further alarms and display of a medication to cease.

20. An electronic timepiece comprising:

an electronic display;

an audible alarm;

programmable storage which stores a medical regimen including identification of medications and times at which the medications are to be taken; and control electronics responsive to the programmable storage to initiate the audible alarm to periodically generate a number of tones corresponding to the number of types of medications yet to be taken at a given time and display of identification and dosage of each medication type when that medication type is to be taken.

21. An electronic watch as claimed in claim 20 wherein the audible alarm sounds periodically until the alarm and medication display are disabled by pressing of a button.

22. An electronic watch as claimed in claim 21 programmable to identify plural medications to be taken at a given time by displaying successive medications as said button is pressed.

23. An electronic watch as claimed in claim 20 wherein the display of identification of a medication comprises display of the name and dosage of the medication.

24. An electronic timepiece comprising:

an electronic display;

an alarm;

programmable storage which stores a medical regimen including identification and dosage of each type of medication and times at which the medications are to be taken and end dates after which each type of medication is no longer to be taken; and control electronics responsive to the programmable storage to initiate the alarm to periodically generate a number of tones corresponding to the number of types of medications yet to be taken at a given time and display of identification and dosage of each medication type when that medication type is to be taken and to cause further alarms and display of a medication type to cease after the end date for that medication type.

* * * * *

UNITED STATES PATENT AND TRADEMARK OFFICE

CERTIFICATE OF CORRECTION

PATENT NO. : 5,157,640

DATED : October 20, 1992

INVENTOR(S) : Brian P. Backner

It is certified that error appears in the above-identified patent and that said Letters Patent is hereby corrected as shown below:

In Claim 17, column 8, line 5, change "claim 15" to ---claim 13---.

Signed and Sealed this

Twenty-eighth Day of September, 1993

Bruce Lehman

*Attest:*

BRUCE LEHMAN

*Attesting Officer*

*Commissioner of Patents and Trademarks*